US006814513B2

(12) United States Patent
Sesek

(10) Patent No.: US 6,814,513 B2
(45) Date of Patent: Nov. 9, 2004

(54) PARCEL WITH PRINTED SHEET WRAPPER, METHOD OF GENERATING A PRINTED SHEET WRAPPER AND COMPUTER READABLE MEDIUM

(75) Inventor: Robert Sesek, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 136 days.

(21) Appl. No.: 10/072,491

(22) Filed: Feb. 5, 2002

(65) Prior Publication Data

US 2003/0147683 A1 Aug. 7, 2003

(51) Int. Cl.[7] ..... B41J 11/44

(52) U.S. Cl. ..... 400/103; 400/61; 400/70; 400/76

(58) Field of Search ..... 400/103, 76, 70, 400/61, 104

(56) References Cited

U.S. PATENT DOCUMENTS

| | | | | | |
|---|---|---|---|---|---|
| 4,201,332 | A | * | 5/1980 | Wooten | 229/92 |
| 4,800,505 | A | * | 1/1989 | Axelrod et al. | 700/221 |
| 4,852,795 | A | * | 8/1989 | Volk, Jr. | 229/92 |
| 6,244,763 | B1 | * | 6/2001 | Miller | 400/76 |
| 6,510,980 | B2 | * | 1/2003 | Halbrook et al. | 229/92.1 |
| 2002/0070266 | A1 | * | 6/2002 | Glenn et al. | 229/92.8 |
| 2002/0110397 | A1 | * | 8/2002 | Bussell | 400/104 |
| 2002/0117410 | A1 | * | 8/2002 | Butler et al. | 206/312 |
| 2002/0149196 | A1 | * | 10/2002 | Fabel | 283/72 |
| 2003/0074435 | A1 | * | 4/2003 | Hobbs | 709/223 |

FOREIGN PATENT DOCUMENTS

| | | | | |
|---|---|---|---|---|
| EP | 0006296 | A | * 1/1980 | B65D/75/54 |
| EP | 0128738 | A | * 12/1984 | B65D/75/54 |
| GB | 1596089 | A | * 8/1981 | B65D/27/20 |

* cited by examiner

*Primary Examiner*—Charles H. Nolan, Jr.

(57) ABSTRACT

In one embodiment of the invention, a parcel comprises an article enclosed in a wrapper folded around the article wherein the wrapper comprises a flat sheet of print media having delivery information and postage printed thereon and folded around the article. In another embodiment, a method comprises simultaneously printing delivery information and postage on a sheet of print media. In another embodiment, a computer useable medium includes computer readable instructions thereon for simultaneously printing delivery information and postage on a sheet of print media.

4 Claims, 12 Drawing Sheets

PARCEL WITH PRINTED SHEET WRAPPER, METHOD OF GENERATING A PRINTED SHEET WRAPPER AND COMPUTER READABLE MEDIUM

FIELD OF THE INVENTION

The present invention is directed to the application of postage and delivery information to a parcel. More particularly, the invention is directed to printing postage and delivery information on a sheet of paper or other print media and then wrapping the contents of the parcel in the sheet.

BACKGROUND OF THE INVENTION

Most hard copy business correspondence is printed on standard size paper that must be folded to fit into a standard size business envelope. Folding the paper detracts from the professional look of the document, especially for larger or customized documents and documents containing printed images or letterhead with seals on it. Printing delivery information on the envelopes for larger or customized documents often requires manually adjusting the printer to accommodate oversized or customized envelopes. Many printers require manual intervention simply to print standard envelopes and print quality on the envelopes is often substandard since the printers are optimized for printing on flat media without creases or folds. Depending on the type of envelope and printer, it is often necessary to print the delivery information on a label and then affix the label to the envelope.

In the case of an envelope type parcel, delivery information is usually printed on the envelope before the contents are inserted. In the case of a box type parcel, delivery information is usually printed on an adhesive label and the label affixed to the parcel. In either case, the parcel is weighed and, based on the size and weight of the parcel, postage is applied to the parcel manually by affixing stamps to the parcel or automatically by a postage metering machine that prints the postage on the parcel. For larger parcels that will not fit through the metering machine, a postage label is printed and then manually affixed to the parcel. Manually applying postage is inefficient and costly in a business environment in which many parcels are posted. Metering large parcels is equally inefficient because the printed postage label must be manually affixed to the parcel. Flat standard size business envelopes are easy to meter, but metering large or bulky envelopes can be difficult especially with the general purpose metering machines used by most small and mid-size businesses. Mail room staff often resort to printed postage labels for large or bulky envelopes rather than fighting to squeeze the upper right hand corner of the envelope into the metering machine.

The present invention was developed in an effort to provide parcel packaging that meets the dual need of preserving the size and shape of the document or other contents while facilitating the application of delivery information and postage to the packaging.

SUMMARY OF THE INVENTION

Accordingly, one embodiment the present invention is directed to a mailing wrapper comprising a flat sheet of paper or other print media having delivery information and postage printed thereon. Another embodiment is directed to a method of forming a mailing wrapper by simultaneously printing delivery information and postage on a sheet of print media. The first embodiment covers a wrapper and requires a flat sheet of paper, but it doesn't matter if the delivery information and postage are printed at the same time or not. The second embodiment covers a method used to form a wrapper and requires simultaneously printing the delivery information and the postage, but does not require a flat sheet of paper.

DETAILED DESCRIPTION OF THE INVENTION

Figure 1:
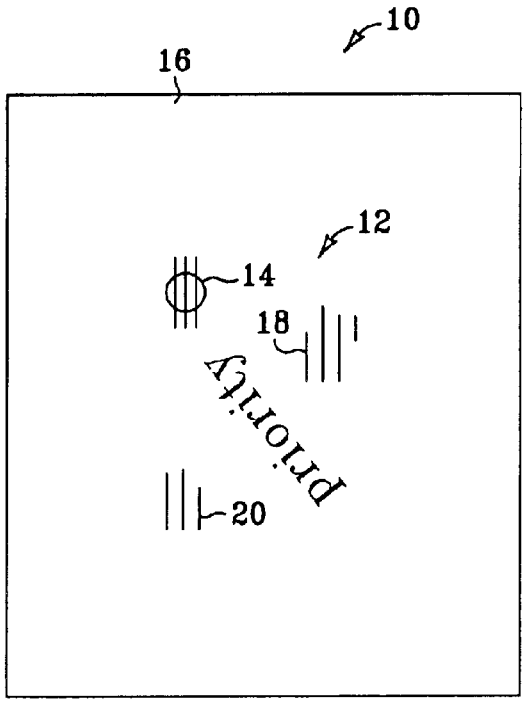
FIG. 1 is a plan view of a mailing wrapper.
Figure 2:
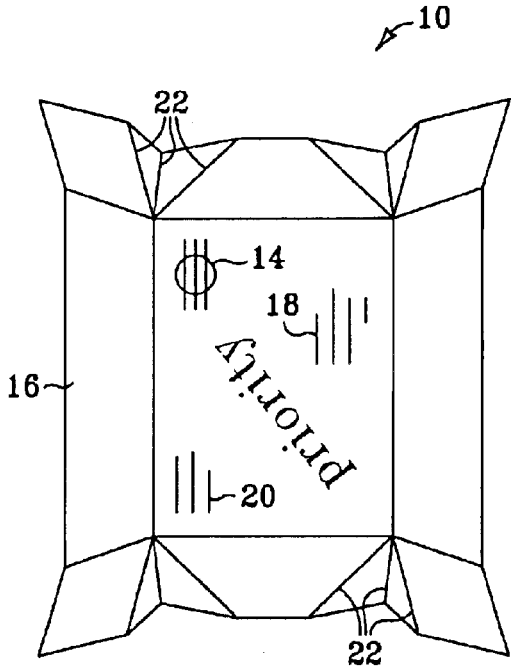
FIG. 2 is a plan view of a mailing wrapper showing fold lines for enclosing a document.
Figure 3:
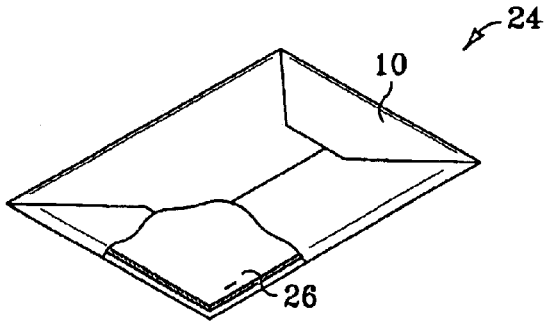
FIG. 3 is a perspective and partial cut-away view of a parcel whose contents are packaged in a mailing wrapper such as the ones shown in FIGS. 1 and 2.

FIG. 1 illustrates one embodiment of the invented mailing wrapper 10. Referring to FIG. 1, mailing wrapper 10 includes delivery information 12 and postage 14 printed on a flat sheet of paper 16 or other print media suitable for use as parcel wrapping. Delivery information 12 includes recipient information 18 and sender information 20. Delivery information 12 might also include a parcel identifier such as a bar code or tracking number and any other information necessary or desirable to facilitate the delivery of a parcel. In FIG. 2, wrapper 10 has been creased along fold lines 22. FIG. 3 illustrates a parcel 24 that includes a multi-page document 26 enclosed in wrapper 10.

Figure 4:
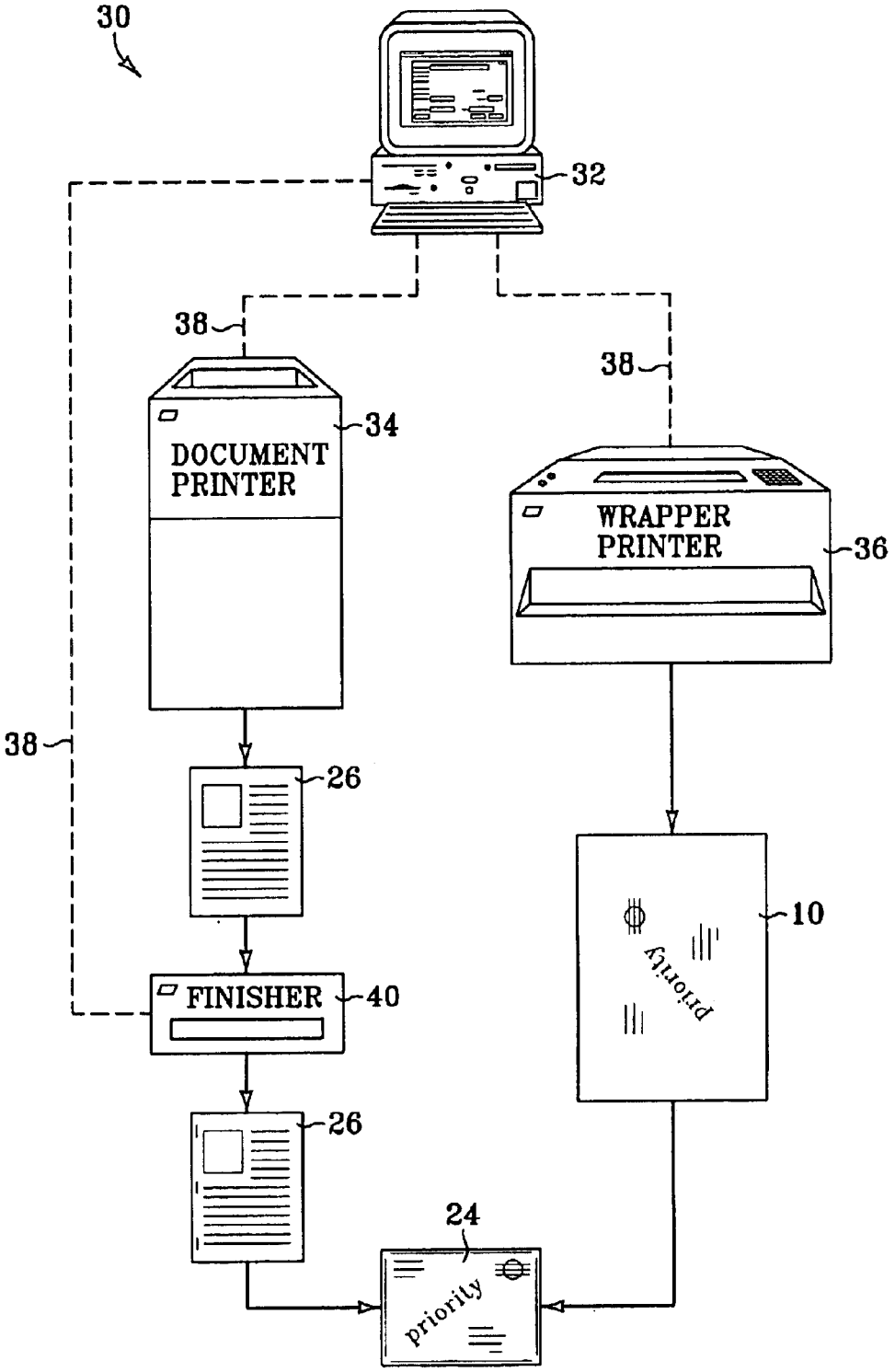
FIGS. 4–8 are schematic diagrams showing various embodiments of a system used to prepare a mailing wrapper and a parcel whose contents are packaged in the mailing wrapper.

FIGS. 4–8 are schematic diagrams showing various embodiments of a system 30 used to prepare a parcel 24 containing document 26 packaged in mailing wrapper 10. Referring first to FIG. 4, system 30 includes a computer 32 operatively coupled to a document printer 34 and a wrapper printer 36 through a communications link 38. Communication link 38 represents generally a cable, wireless, or remote connection via a telecommunication link, an infrared link, a radio frequency link, or any other connector or system that provides electronic communication between devices 32, 34, and 36. Communication link 38 may represent an intranet, the Internet, or a combination of both. The path followed by link 38 between devices 32, 34, and 36 in the schematic view of FIG. 4 represents the logical communication path between these devices, not necessarily the physical path between the devices. Devices 32, 34, and 36 can be connected to a network at any point and the appropriate communication path established logically between the devices.

The instructions for printing document 26 are generated on computer 32 using any conventional document generating application software and the appropriate printer driver. These instructions are transmitted to document printer 34, typically as a discrete print job, and the document is printed. For multi-page documents, the print instructions may also be accompanied by finishing instructions. A finishing device 40 operatively coupled to computer 32 through link 38 receives and executes the finishing instructions for document 26. In FIG. 4, document 26 is shown finished with three staples binding the document along the left side margin. Although finishing device 40 is shown in the Figures as a discrete component, finishing device 40 may be integrated into document printer 34. High end printers often include integral sorter/staplers and other more complex finishing devices.

In the embodiment of FIG. 4, in which wrapper printer 36 is linked to computer 32, the processing to determine the appropriate printing parameters for wrapper 10 is, preferably, performed by computer 32 rather than wrapper printer 36. The wrapper size, delivery information and postage, for example, are determined by computer 32 and transmitted to wrapper printer 36 as part of the wrapper print job. In this way, wrapper printer 36 functions much like a conventional printer and any conventional printer or plotter that can handle the desired wrapping paper or other wrapper media may be used.

Figure 5:
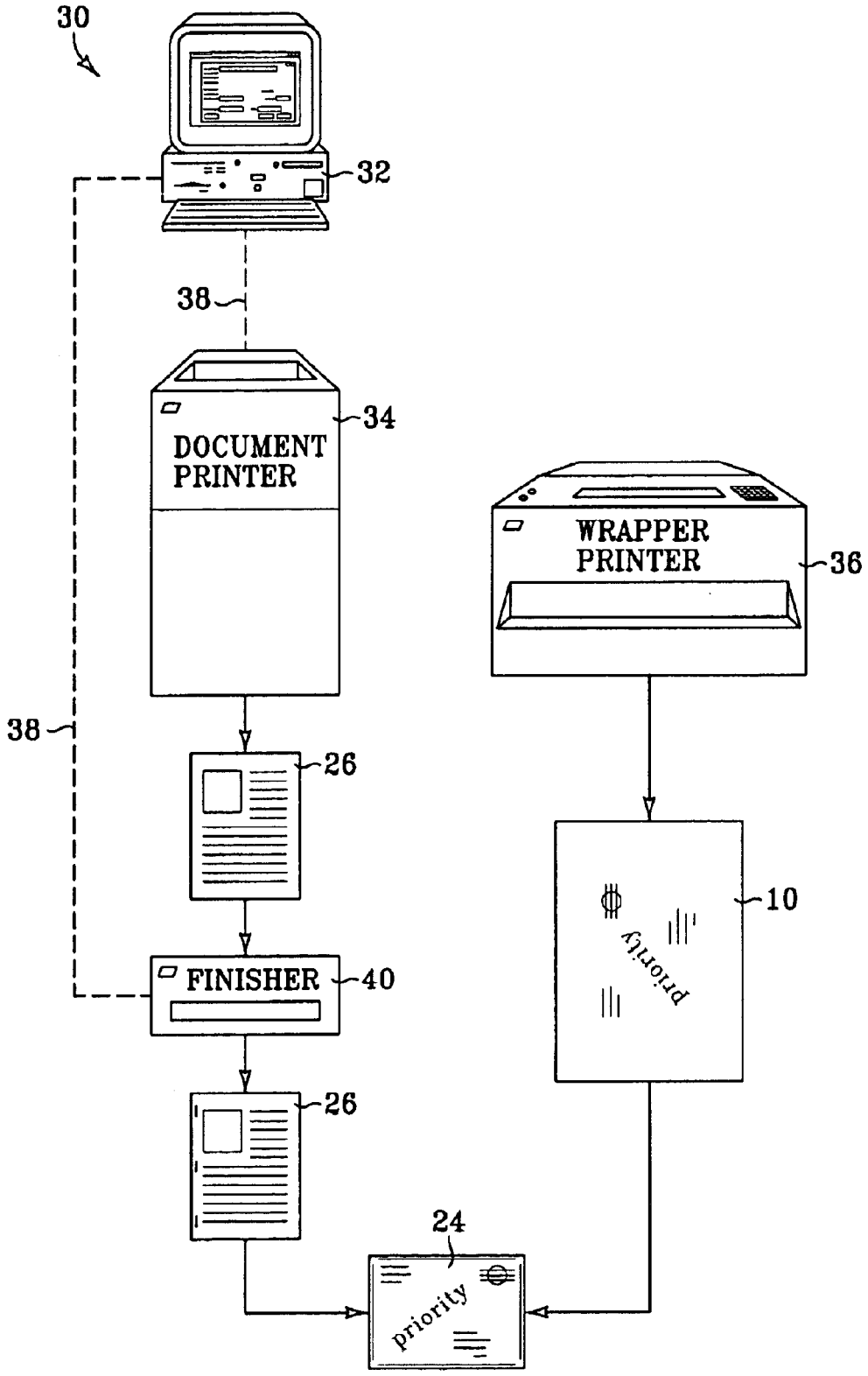

FIG. 5 illustrates an alternative embodiment in which wrapper printer 36 is a stand alone unit. For a stand alone unit such as that shown in FIG. 5, the user must key in or otherwise communicate to wrapper printer 36 the requisite wrapper printing parameters, such as wrapper size and the amount of postage, or information that allows the stand alone wrapper printer 36 to compute the appropriate wrapper size and required postage.

Figure 6:
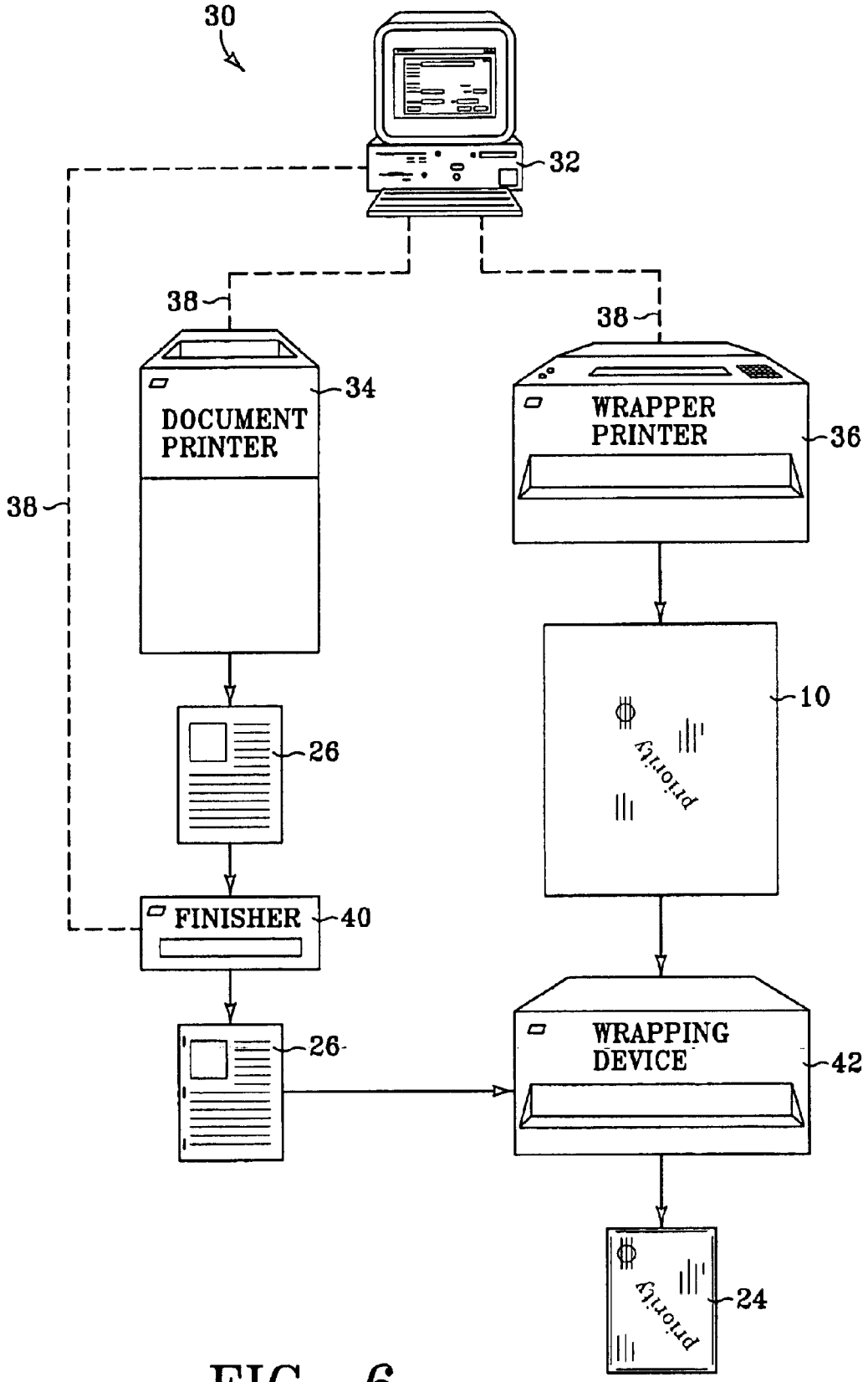

In the embodiment shown in FIG. 6, system 30 also includes a wrapping device 42 that wraps document 26 in wrapper 10 to produce parcel 24.

Figure 7:
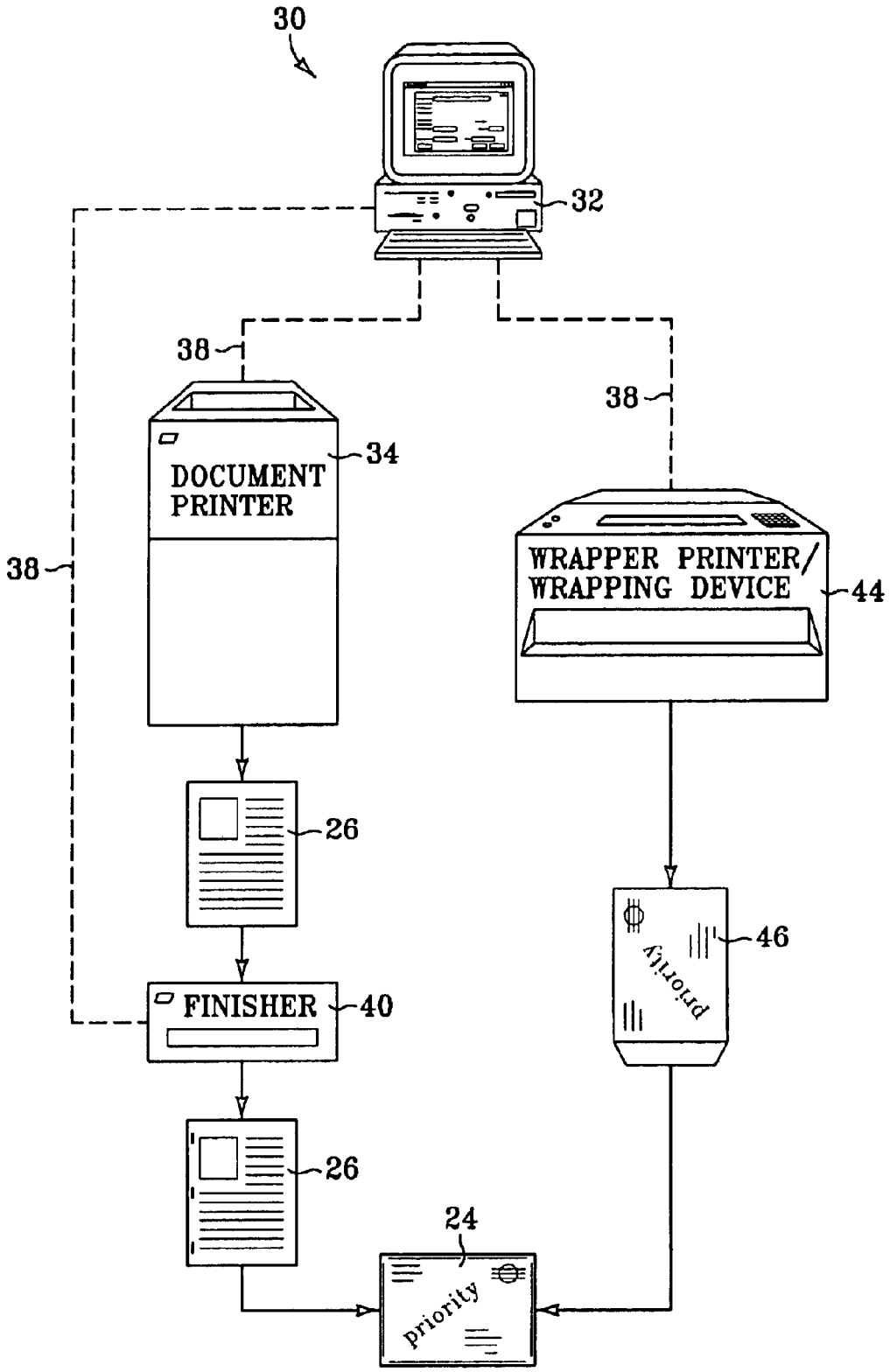

In the embodiment shown in FIG. 7, the wrapper printer and a wrapping device are integrated into a single unit 44 that produces a custom pre-printed envelope 46.

Figure 8:
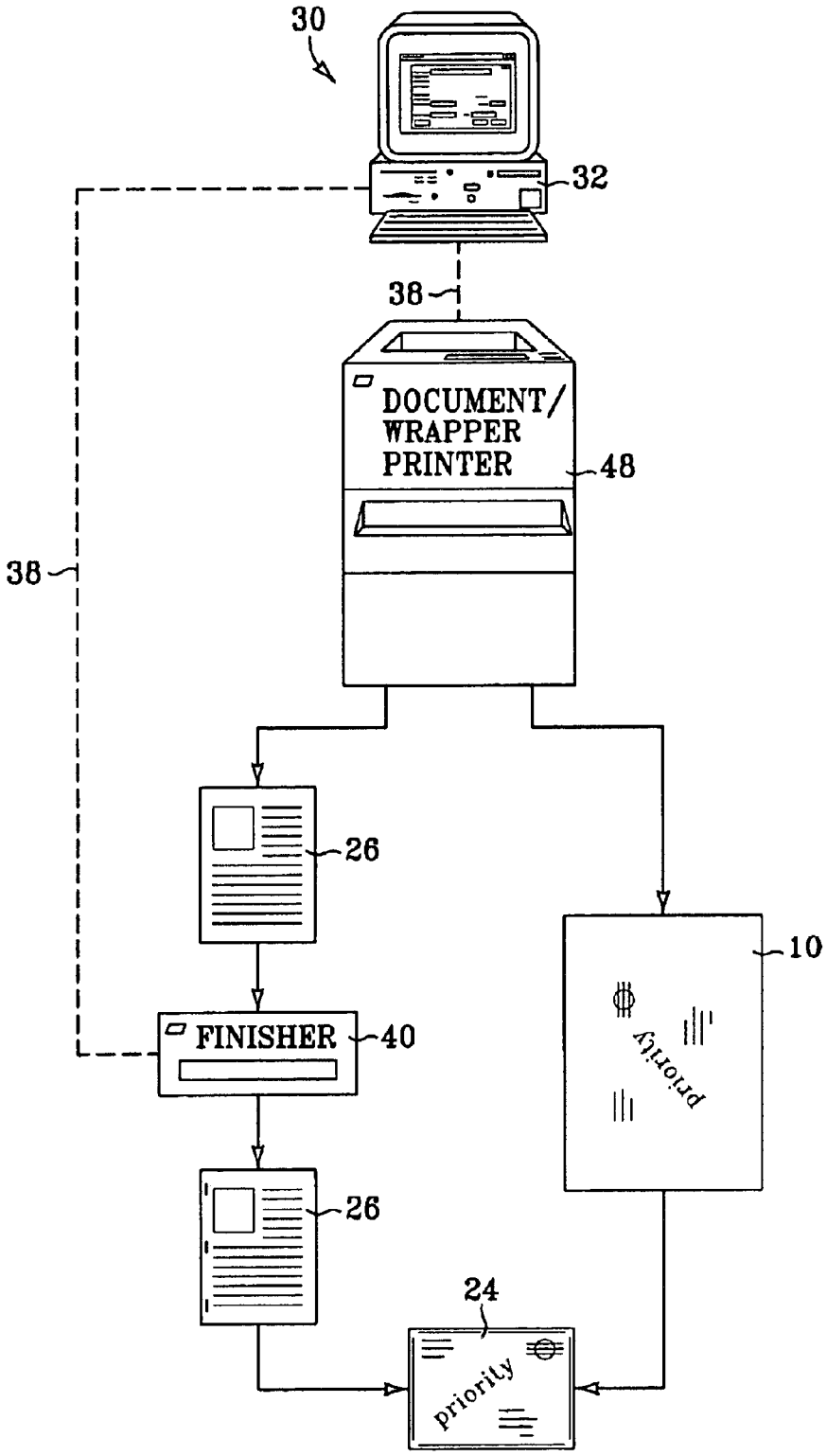

In the embodiment of FIG. 8, document 26 and wrapper 10 are printed by the same printer 48. It is expected this embodiment will be used when printing a large volume of smaller envelope style wrappers such as might be used for ordinary business correspondence.

Although these embodiments contemplate simultaneously printing delivery information and postage at the direction of computer 32, other embodiments are possible. For example, wrappers pre-printed with postage or delivery information, or both, might also be used as the feed stock for wrapper printer 36, wrapping device 42, or manually wrapping the contents of parcel 24.

FIGS. 9–12 illustrate a set of menu selections typical of those available to a user to develop the instructions necessary to print document 26 and wrapper 10. Preferably, these menu selections are displayed to the user through computer 32 as part of the document generating application software or as part of a utility used in conjunction with the document generating software or printer driver. In either case, the menus reflect the different attributes of a print job needed to estimate the weight of the parcel to compute postage and to select or determine the appropriate wrapping.

Figure 9:
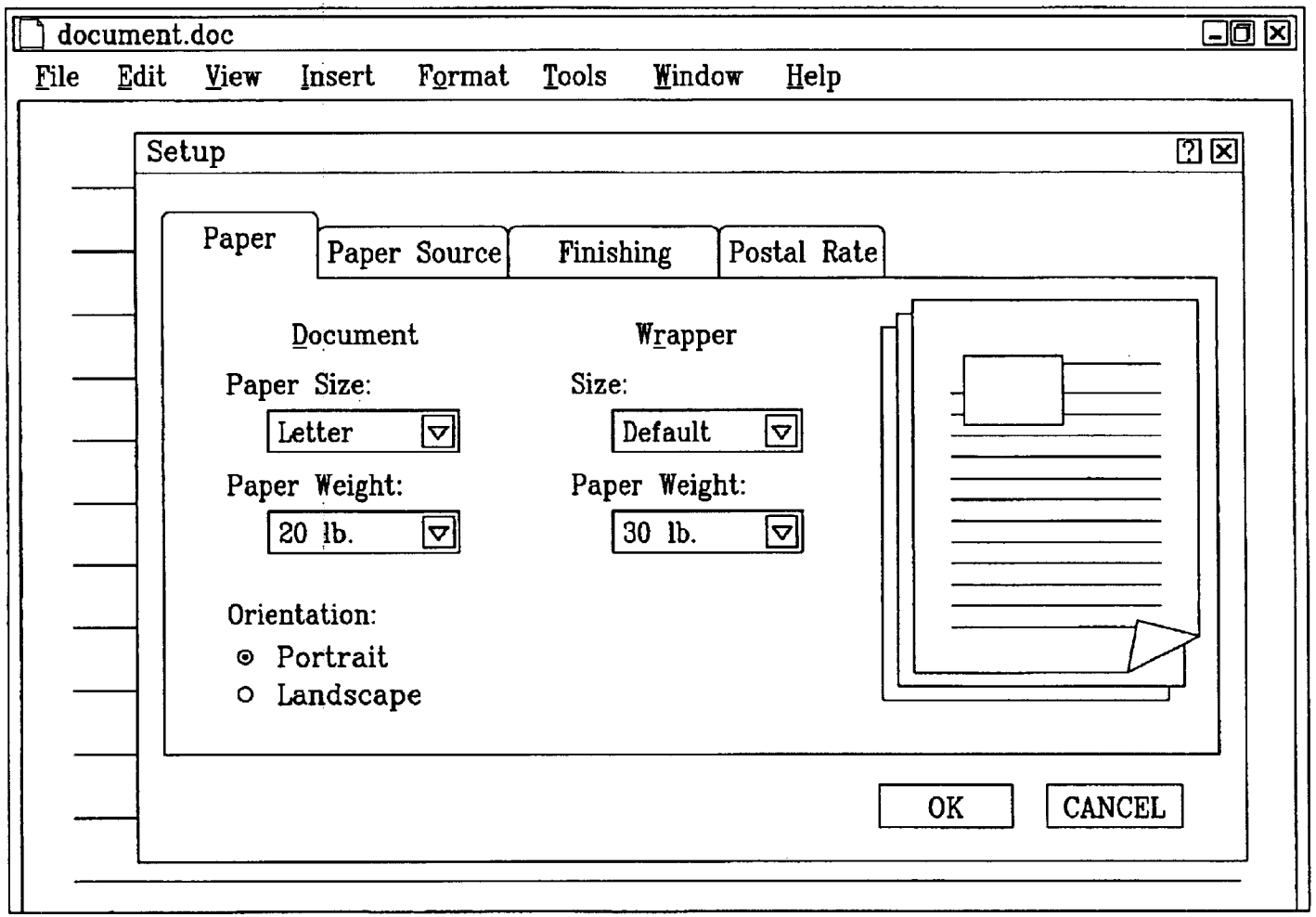
FIGS. 9–12 illustrate a set of menu selections typical of those available to a user to develop the instructions necessary to print the document and the mailing wrapper.

In FIG. 9, the Paper tab is selected to display the paper size, weight and orientation and the wrapper size and weight. Letter size 20 lb. paper has been selected for portrait printing along with the default size 30 lb. wrapping paper. When the default size wrapping paper is selected, the appropriate size wrapping paper is automatically determined based on the selected paper size. For example, wrapper size may default to a size about twice that of the size of the document. So, the default size wrapper for 8½"×11" and A4 paper is about 17"×22".

Figure 10:
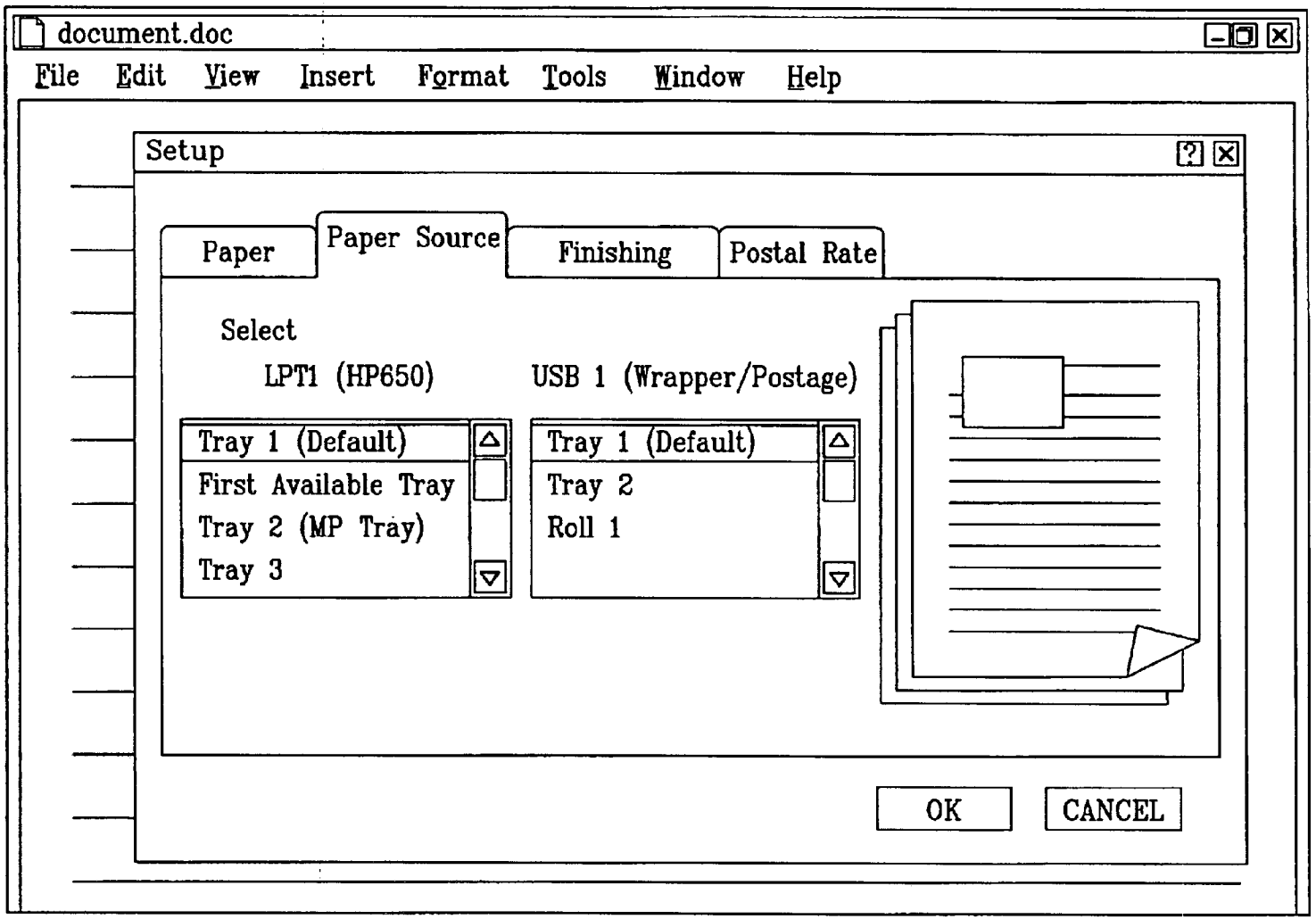

In FIG. 10, the Paper Source tab is selected to display the different paper trays or other sources available for the document media and the wrapper media. For example, if a printer and a plotter are available to print the wrapper, then both media trays and a paper or other media roll can be used for printing the wrapper. Rolls of varying width, from which sheets of any length can be cut, offer unlimited size options for wrapper 10. The default media tray for the print media and the wrapper media is selected consistent with the selection of the standard size 8½"×11" document paper and 17"×22" sheets of wrapping paper.

Figure 11:
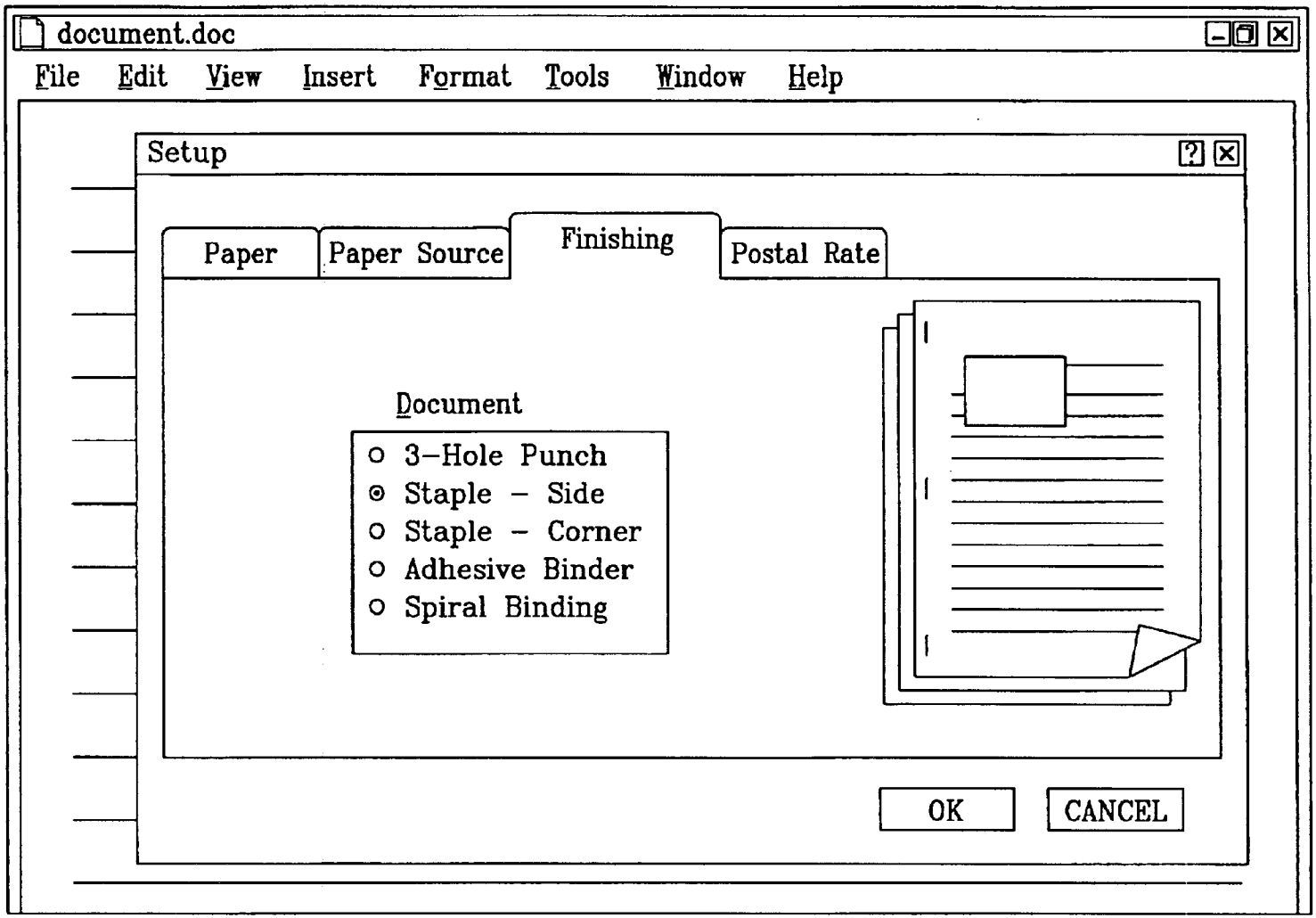

In FIG. 11, the Finishing tab is selected to display binding options and any other finishing options that might be available. Side stapling is selected.

Figure 12:
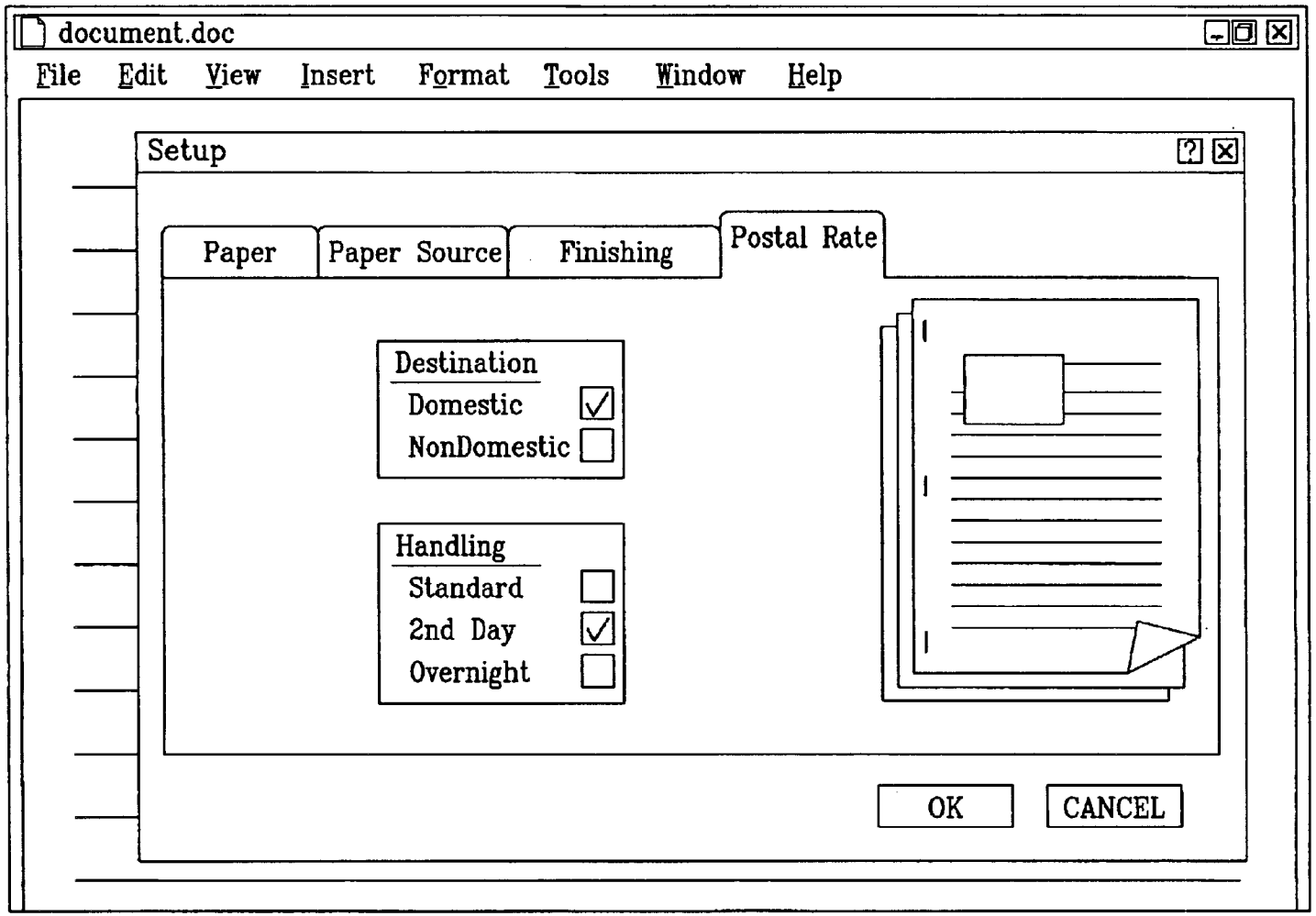

In FIG. 12, the Postal Rate tab is selected to display mailing options. Domestic two day delivery is selected. Postage calculator software on computer 32 computes the required postage based on the estimated weight of a parcel 24 having the selected document and wrapper attributes. One suitable postage calculator is disclosed in U.S. patent application Ser. No. 09/976,704 filed Oct. 11, 2001 and titled Smart Business Manager Postal Calculator. The '704 Application is incorporated herein by reference in its entirety.

Figure 13:
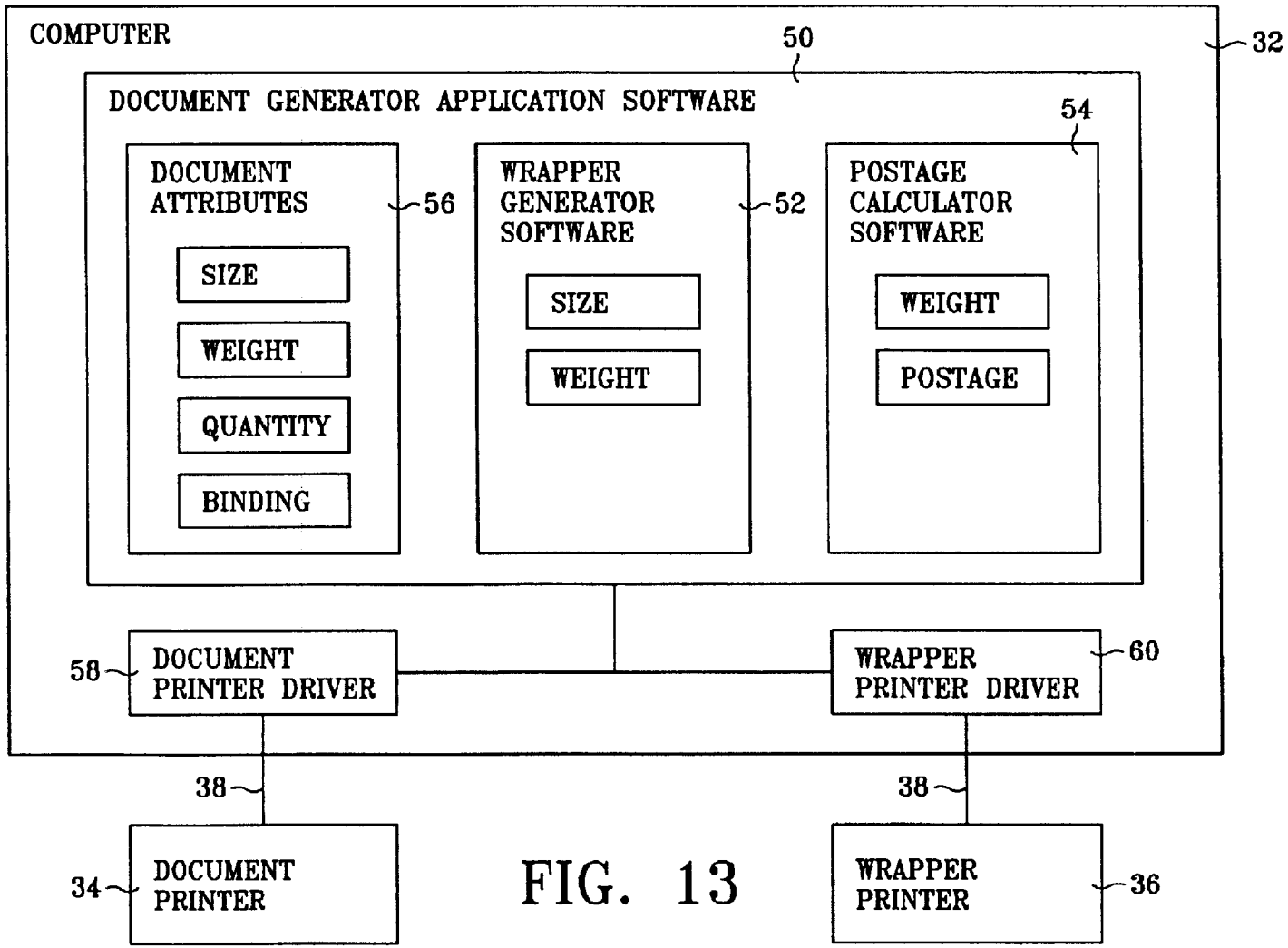
FIG. 13 is a block diagram showing software modules for generating a mailing wrapper such as the one shown in FIG. 1.
Figure 14:
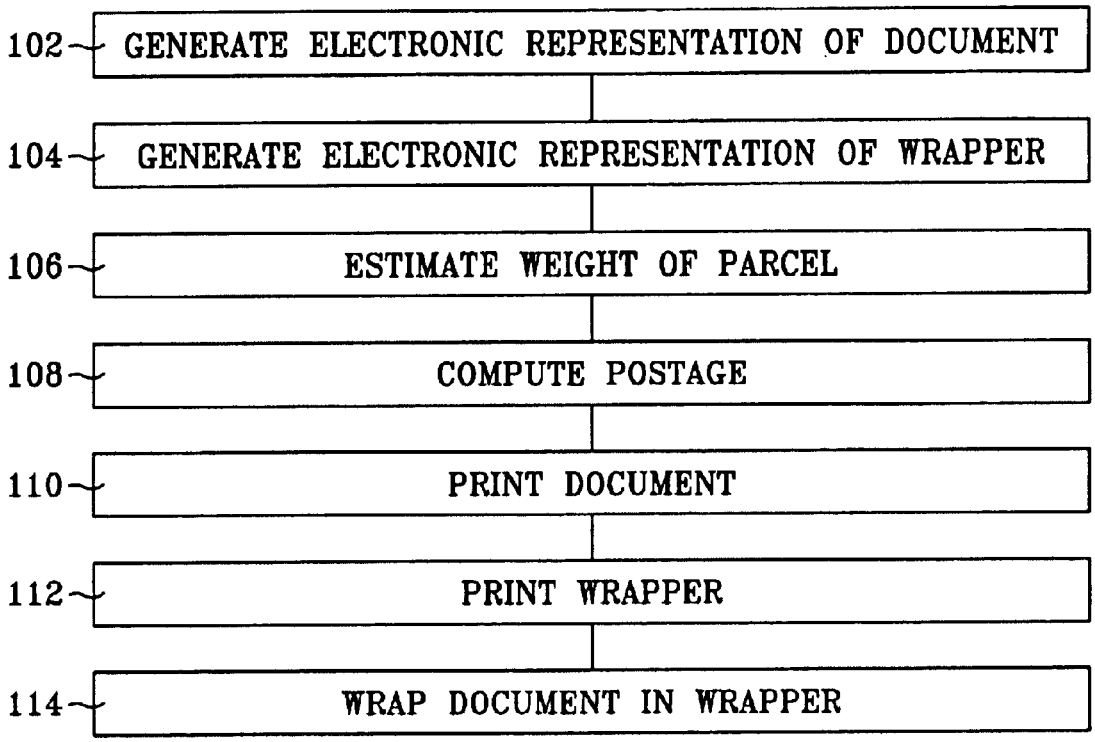
FIG. 14 is a flow diagram illustrating one method for generating a mailing wrapper such as the one shown in FIG. 1.

The operation of system 30 will now be described with reference to the block diagram of FIG. 13 and the flow diagram of FIG. 14 where a printed document 26 is the article that will be enclosed in wrapper 10. Referring to FIGS. 13 and 14, an electronic representation of document 26 is generated through document generating application software 50 running on computer 32 (step 102). An electronic representation of wrapper 10 is generated through mailing wrapper software 52 running on computer 32 (step 104). In the embodiment shown in FIG. 13, mailing wrapper software 52 is integrated into document generating application software 50. The weight of a parcel 24 that includes document 26 enclosed in wrapper 10 is estimated based on document and wrapper attributes such as those noted in blocks 52 and 56, and the postage calculated based on the estimated weight by postage calculator software 54 running on computer 32 (steps 106 and 108). In the embodiment shown in FIG. 13, postage calculator software is integrated into document generating application software 50. The electronic representation of document 26 is transmitted via link 38 to document printer 34 through the appropriate printer driver 58 and printed (step 110). The electronic representation of wrapper 10 is transmitted via link 38 to wrapper printer or plotter 36 through the appropriate printer driver 60 and printed (step 112). Document 26 is wrapped in wrapper 10 (step 114) to complete the formation of parcel 24.

Although the flow chart of FIG. 14 suggests a specific order of execution, the order of execution may differ from that which is depicted. For example, the order of execution of two or more blocks may be scrambled relative to the order shown. Also, two or more blocks shown in succession in FIG. 14 may be executed concurrently or with partial concurrence. For example, generating an electronic representation of the wrapper must necessarily overlap computing postage because the postage must be known before the full image of the wrapper can be generated. All such variations are within the scope of the present invention. Moreover, the screen displays of FIGS. 9–12 are exemplary only. There exist many possible layout and control configurations for a user interface that will allow a user to select and return configuration settings. FIGS. 9–12 provide just one example.

"Software" and other logical components of the invention can be embodied in any computer-readable medium for use by or in connection with an instruction execution system such as a computer/processor based system or other system that can fetch or obtain the logic from the computer-readable medium and execute the instructions contained therein. The computer readable medium can comprise any one of many physical media such as, for example, electronic, magnetic, optical, electromagnetic, infrared, or semiconductor media. More specific examples of a suitable computer-readable medium would include, but are not limited to, a portable magnetic computer diskette such as floppy diskettes or hard drives, a random access memory (RAM), a read-only memory (ROM), an erasable programmable read-only memory, or a portable compact disc.

While the present invention has been shown and described with reference to the foregoing exemplary embodiments, it is to be understood that other forms, details, and embodiments may be made without departing from the spirit and scope of the invention which is defined in the following claims.

What is claimed is:

1. A method, comprising:

generating an electronic representation of a printed document;

generating an electronic representation of a wrapper to enclose the document, the wrapper comprising a flat sheet of print media including delivery information and postage;

computing the weight of a parcel including the wrapper enclosing the document based on the electronic representations of the wrapper and the document;

computing postage for the parcel;

printing the document; and printing the wrapper.

2. The method of claim 1, further comprising wrapping the document in the wrapper.

3. A computer useable medium having computer readable instructions thereon for:

generating an electronic representation of a printed document;

generating an electronic representation of a wrapper to enclose the document, the wrapper comprising a flat sheet of print media including delivery information and postage;

computing the weight of a parcel including the wrapper enclosing the document based on the electronic representations of the wrapper and the document;

computing postage for the parcel;

printing the document; and printing the wrapper.

4. The medium of claim 3 having further instructions thereon for wrapping the document in the wrapper.

* * * * *